US011713590B2

(12) United States Patent
Hanna et al.

(10) Patent No.: US 11,713,590 B2
(45) Date of Patent: Aug. 1, 2023

(54) FENCE DEVICES

(71) Applicants: Katherine F. Hanna, Hayden, ID (US); Kim D. Hanna, Hayden, ID (US)

(72) Inventors: Katherine F. Hanna, Hayden, ID (US); Kim D. Hanna, Hayden, ID (US)

( * ) Notice: Subject to any disclaimer, the term of this patent is extended or adjusted under 35 U.S.C. 154(b) by 193 days.

(21) Appl. No.: 16/907,824

(22) Filed: Jun. 22, 2020

(65) Prior Publication Data

US 2021/0396040 A1 Dec. 23, 2021

(51) Int. Cl.
*E04H 17/14* (2006.01)

(52) U.S. Cl.
CPC ..... *E04H 17/143* (2013.01); *E04H 17/1447* (2021.01)

(58) Field of Classification Search
CPC ..... E04H 17/1413; E04H 17/1447; E04H 17/1448; E04H 17/1452; E04H 17/1488; F16B 7/048; F16B 7/0486; F16B 9/058; Y10T 403/42; Y10T 403/71
USPC ..... 256/65.02, 65.03
See application file for complete search history.

(56) References Cited

U.S. PATENT DOCUMENTS 3,384,351 A 5/1968 Turner, Jr.
3,713,624 A 1/1973 Niemann
5,622,356 A * 4/1997 Duggan ..... E04H 12/2292 52/170
5,685,522 A * 11/1997 Randolph, Jr. ..... E04H 17/063 52/170
6,141,926 A * 11/2000 Rossiter ..... E04B 2/7425 52/239
6,379,074 B1 * 4/2002 Chin ..... F16B 7/0486 403/231
6,543,751 B1 * 4/2003 Spruill ..... E04H 17/1413 403/384
6,561,491 B2 5/2003 Thompson et al.
6,837,487 B1 1/2005 Oden et al.
7,503,533 B1 * 3/2009 Sammann ..... F16B 9/058 248/200
8,414,068 B1 * 4/2013 Na ..... B62D 27/023 296/193.06
8,936,233 B1 * 1/2015 Sneith ..... E04F 11/1814 256/67
9,200,443 B2 * 12/2015 Marple ..... F16B 7/00
9,234,365 B2 1/2016 Knudsen
9,416,559 B2 * 8/2016 Brechon ..... E04H 17/20
9,833,689 B2 * 12/2017 Smith ..... A63C 19/10
10,145,109 B2 12/2018 Knudsen
11,002,038 B2 * 5/2021 McCarroll ..... E04H 17/1447
2005/0274938 A1 12/2005 Nesbitt
2006/0169967 A1 * 8/2006 Platt ..... E04H 17/1413 256/65.02

(Continued)

FOREIGN PATENT DOCUMENTS

DE 202008002253 U1 * 8/2009 ..... F16B 7/0486
DE 102008027487 B3 * 9/2009 ..... E04H 17/063
KR 20130092227 A * 2/2012

*Primary Examiner* — Jonathan P Masinick
(74) *Attorney, Agent, or Firm* — Brooks, Cameron & Huebsch, PLLC

(57) ABSTRACT

An example detachable device comprises a body with a transitional surface, a back portion, and a side portion. The body is to be affixed to a rail of a fence structure with the back portion in proximity to a surface of the rail. The side portion of the body is to be arranged proximate to a post portion of the fence structure.

20 Claims, 4 Drawing Sheets

(56) References Cited

U.S. PATENT DOCUMENTS

| | | | | |
|---|---|---|---|---|
| 2008/0111118 | A1* | 5/2008 | Powell | E04H 17/26<br>256/65.02 |
| 2008/0246012 | A1 | 10/2008 | Brush | |
| 2009/0126298 | A1 | 5/2009 | Salcedo | |

* cited by examiner

FENCE DEVICES

BACKGROUND

Fences often are made up of post structures with rail structures spanning from post-to-post. At times, at the junction of posts and rails, a ninety-degree angle may be formed by the junction of post and rail surfaces.

BRIEF DESCRIPTION OF THE DRAWINGS

Various examples will be described below by referring to the following figures.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration.

DETAILED DESCRIPTION

Fences can be made up of many different materials and structures. For example, fences may comprise polymer materials, such as vinyl or plastic. Typically, such fences include post members that are secured to the ground (e.g., using cement). Fence rails span from post to post, enabling the space between posts to be filled. In some cases, a portion of the rails will enter an opening of the post into which they are secured.

The location in the fence at which the rails and the posts join together is referred to as a junction (alternatively referred to hereinafter as rail-post junctions). Typically, an outer surface of the rails is not coplanar with an outer surface of the fence posts. Thus, at fence junctions, the rail may be recessed as compared with a facing surface of the post. Typically, the surface of the rail will intersect a side surface of a post at a ninety-degree angle. Thus, vegetation growing along the fence will also tend to grow in the space including the ninety-degree angle formed by the rail and side surface of the post.

In the junction of the rail and the post, vegetation growing may be difficult to reach, such as by circular cutters. For instance, wire or line-based cutters (e.g., also referred to as line edgers or weed wackers) may tend to damage fence posts and rails when trying to reach vegetation in such corners. The cutting swath of such circular cutters may not correspond to the square angles of the rail-post junctions.

In addition to the challenge of reaching vegetation in the ninety-degree rail-post junction angles, it can be challenging to provide protection against vegetation growth in fence corners, such as because existing solutions may be designed to span across a front surface of a post and such front surfaces may not be available in fence corners (e.g., comprising a fence post receiving fence rails that are non-parallel with respect to each other).

Therefore, there may be a desire for an approach of controlling vegetation growth in junctions of rails and fences, including rails and fences that are part of a corner of a fence.

In one example, the present disclosure proposed a detachable device capable of filling fence post and rail junctions, such as even at corners of a fence. The detachable device comprises a transitional surface and is attachable to the rail.

Figure 1:
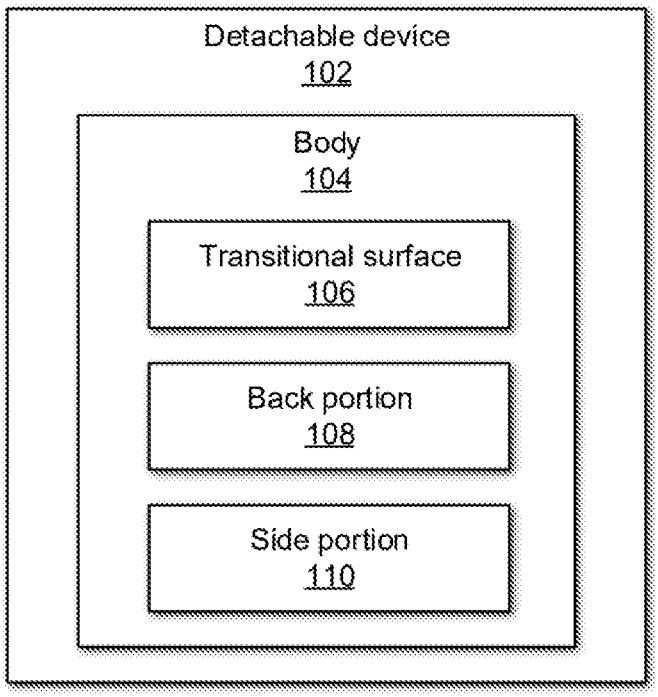
FIG. 1 is an illustration of an example of a block diagram of an example detachable device.

FIG. 1 is a block diagram illustrating an example detachable device capable of filling rail-post junctions, such as without attaching to a front surface of a post. FIG. 1 comprises a detachable device 102. Detachable device 102 refers to a structure that may be attached to and detached from a fence structure, such as by use of a fastener. Detachable device 102 includes a body 104, which may be made of synthetic plastics such as vinyl, nylon, polypropylene, polythene, or various recycled plastics, by way of non-limiting example.

Transitional surface 106 refers to a front surface of body 104 that spans from a surface of a fence rail to a fence post. In one implementation, transitional surface 106 may be defined by a continuous plane extending between the fence rail surface to the fence post surface. However, in other examples, transitional surface may be defined by a number of surfaces, as shall be discussed in greater detail hereinafter.

Back portion 108 refers to a portion of body 104 that is to be arranged in proximity to the rail surface. For instance, in some examples, back portion may include a number of structural features (e.g., ribs, surfaces, apertures, etc.) that may contact the rail surface, such as to be affixed thereto. Side portion 110 refers to a portion of body 104 that is to be arranged in proximity to the post surface that forms a square angle with the rail surface that is in proximity to back portion 108. Side portion 110 may also include structural features, similar to those of back portion 108, and may be arranged to contact the post surface, such as to be affixed thereto.

In one example, detachable device 102 may be affixed to a surface of the rail of a fence such that back portion 108 contacts the rail surface (e.g., using fasteners and/or adhesives). Likewise, side portion 110 may be in proximity to a surface of the post. Body 104 of detachable device 102 may thus fill a rail-post junction formed at the junction of the rail and the post. Additional fasteners may be used to also affix the device to the post in some implementations. Transitional surface 106 may thus span from the surface of the rail to the surface of the post. The profile of the transitional surface may be such that a circular cutter will not damage the rail and the post in attempting to reach vegetation (e.g., because the rail-post junction is filled by body 104).

With the foregoing in mind, one example detachable device (e.g., detachable device 102) may include a body (e.g., body 104). The body may include a transitional surface (e.g., transitional surface 106), a back portion (e.g., 108), and a side portion (e.g., 110). The body is to be affixed to a rail of a fence structure with the back portion in proximity to a surface of the rail. And the side portion of the body is to be arranged proximate to a post portion of the fence structure. In one example of the detachable device, the body comprises a polyvinyl chloride material.

Figure 2A:
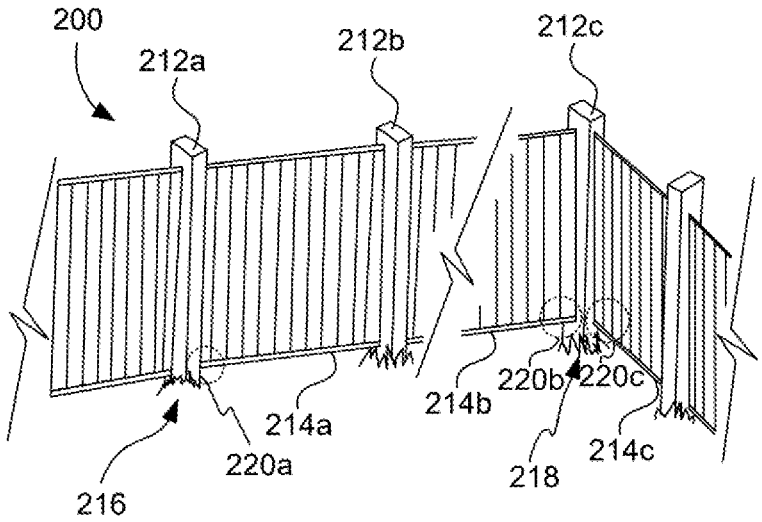
FIGS. 2A-2C illustrate other example devices in relation to a fence system.
Figure 2B:
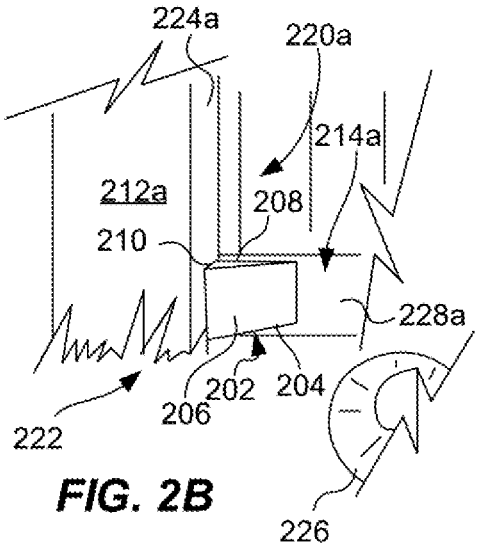
Figure 2C:
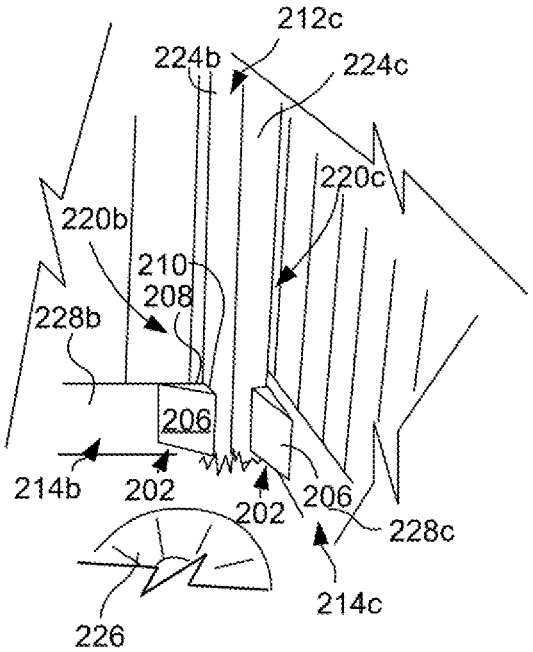

FIGS. 2A-2C illustrate how examples of a detachable device, such as detachable device 102 in FIG. 1, may operate in relation to an example fence system 200. First, it is noted that the present description uses a number scheme wherein like numbers are used to represent elements for which structure and function is similar. For instance, detachable device 102 in FIG. 1 is similar in structure and function to detachable device 202 in FIGS. 2A-2C. To simplify the present description, therefore, discussion of claim elements is not repeated for each drawing. It is to be understood, however, that possible structure and/or operation discussed with relation to one or more implementations is not necessarily to be understood as being present for other implementations, unless explicitly stated to the contrary. For example, a particular arrangement of an example transitional surface may be discussed in one example but may differ in other examples.

Turning to FIG. 2A, an example fencing system 200 is illustrated comprising a number of posts 212*a*, 212*b*, and 212*c*, which are shown connected to the ground. A number of rails, of which example rails 214*a*, 214*b*, and 214*c* are labeled, span posts 212*a*, 212*b*, and 212*c* (e.g., and have connection portions that interface with openings in the posts). As noted in FIG. 2A, a number of junction points 220*a*, 220*b*, and 220*c* are highlighted and in which vegetation may grow and that may be difficult to access, such as using a circular cutter. As mentioned above, there may be a desire for a device that may be used in both straight run junctions (e.g., straight run junction 216) and corner junctions (e.g., corner junction 218) in order to limit vegetation growth in junction points. As used herein, straight run junctions refer to rail-post-rail junctions in which rails on either side of the post are approximately co-planar and are attached to opposing sides of the post. In contrast, corner junctions refer to rail-post-rail junctions in which rails on either side of the post are approximately perpendicular and are attached to adjacent sides of the post. FIGS. 2B and 2C illustrate an example detachable device 202 arranged in junction points 220*a*, 220*b*, and 220*c*.

FIG. 2B illustrates one example detachable device 202, which may be affixed at junction point 220*a* of rail 214*a* of the straight run junction 216, such that back portion 208 of body 204 contacts a surface 228*a* of the rail 214*a* and the side portion 210 of body 204 may be in proximity to a surface of the post 212*a* (e.g., in some examples, side portion 210 may also be affixed to post surface 224*a*). Body 204 of detachable device 202 may thus fill a straight run rail-post junction formed at the junction of the rail and the post. Transitional surface 206 may thus span from the surface of the rail 214*a* (rail surface 228*a*) to the surface of the post 212*a* (post surface 224*a*), filling the space at the straight run junction 216.

FIG. 2C illustrates two additional example detachable devices, 202. The first example detachable device 202, which may be affixed at junction point 220*b* of the rail 214*b* of the corner junction 218 (labeled in FIG. 2A), such that back portion 208 of body 204 contacts the surface (e.g., rail surface 228*b*) of rail 214*b* and side portion 210 of body 204 may be in proximity to a surface of the post 212*c* (e.g., in some examples, side portion 210 may also be affixed to post surface 224*b*). Body 204 (not labeled in FIG. 2C, see FIGS. 1 and 2B) of detachable device 202 may thus fill a corner rail-post junction formed at the junction of the rail and the post. Transitional surface 206 may thus span from the surface of the rail 214*b* (e.g., rail surface 228*b*) to the surface of the post 212*c* (e.g., post surface 224*b*). In some examples, side portion 210 may also be affixed to post surface 224*b*. Advantageously, and as noted above, another detachable device of a similar implementation may also be arranged in neighboring junction point 220*c*. Thus, detachable device 202 may also be affixed at junction point 220*c*, which comprises the rail 214*c* connected to post 212*c* at the corner junction 218 (labeled in FIG. 2A). In this example, such as in the example of junction point 220*b*, back portion 208 (not labeled in FIG. 2C, see FIGS. 1 and 2B) of device 202 contacts the rail surface 228*c* of rail 214*c* and side portion 210 (not labeled in FIG. 2C, see FIGS. 1 and 2B) of device 202 may be in proximity to a surface 224*c* of the post 212*c*. Body 204 (not labeled in FIG. 2C, see FIGS. 1 and 2B) of detachable device 202 may thus fill a corner rail-post junction formed at the junction of the rail and the post. Transitional surface 206 may thus span from the surface of the rail 214*c* (e.g., rail surface 228*c*) to the surface of the post 212*c* (post surface 224*c*). As should be apparent, the combination of multiple detachable devices (e.g., detachable device 202) may be used to fill two junction points (e.g., junction points 220*b* and 220*c*) of a corner junction 218 to fill the space at the corner junction 218 in which vegetation (e.g., vegetation 222, as labeled in FIG. 2B) may grow (and that may be difficult to reach with a circular cutter).

FIGS. 2B and 2C also illustrate a cutter swath 226 to show that the profile of detachable devices 202 (e.g., due to transitional surface 206) may correspond to cutter swath 226. For instance, transitional surface 206 may span from a rail surface (e.g., rail surfaces 228*a*, 228*b*, or 228*c*) to a post surface (e.g., post surfaces 224*a*, 224*b*, or 224*c*). In so doing, an angle between a plane defined by transitional surface 206 and a plane defined by a rail surface (e.g., rail surface 228*a*) may be greater than ninety degrees (e.g., obtuse). Likewise, an angle between the plane of transitional surface 206 and the plane of a post surface (e.g., post surface 224*a*) may also be greater than ninety degrees (e.g., obtuse).

While at times, a straight (e.g., planar) surface may be suitable for transitional surface 206, other forms and profiles are also contemplated by claimed subject matter. For example, transitional surface 206 may define an arc, such as when viewed from above. The arc may correspond to an arc of cutter swath 226. For instance, for a cutter swath with a radius of 6 inches, the arc defined by transitional surface 206 may be approximately 6 inches.

As should be appreciated from the foregoing, an example detachable device may be of interest, such as to fill junction points between rails and fence posts. Further, such example detachable devices may also be of interest for being usable in a number of contexts, such as for straight run junctions and corner junctions of fence systems.

With the foregoing in mind, an example fencing system (e.g., fencing system 200) may comprise a fence post (e.g., fence post 212*a*), a fence rail (e.g., fence rail 214*a*), and with a detachable device body (e.g., body 204 of detachable device 202) arranged in a junction point (e.g., junction point 220*a*) formed by the fence post and the fence rail, which contact each other at an angle. The body is affixed to the fence rail to fill a space between the vertex of the angle and an outer surface of the body, opposite the vertex (as shall be discussed in further detail hereinafter with reference to FIGS. 4A-4C).

In some cases, the fence post and the fence rail may comprise a polyvinyl chloride material.

Figure 3A:
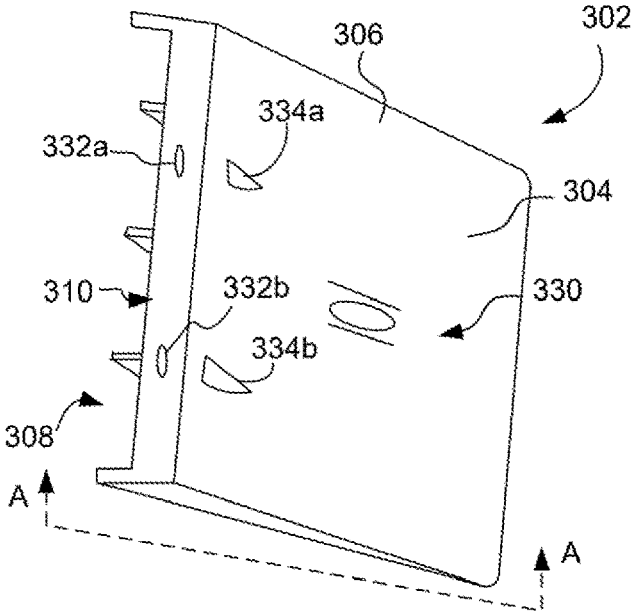
FIGS. 3A-3C are perspective views of the transitional surface, side surface, and back surface of an example device.
Figure 3B:
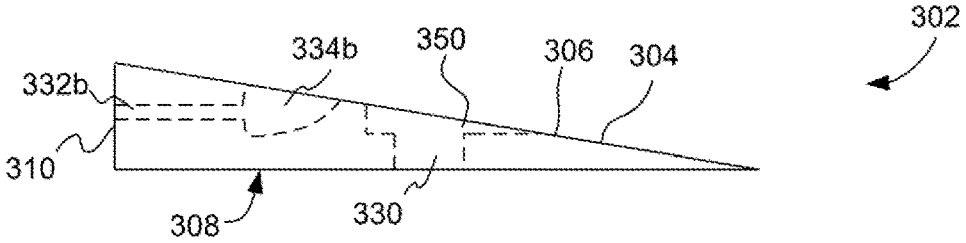
Figure 3C:
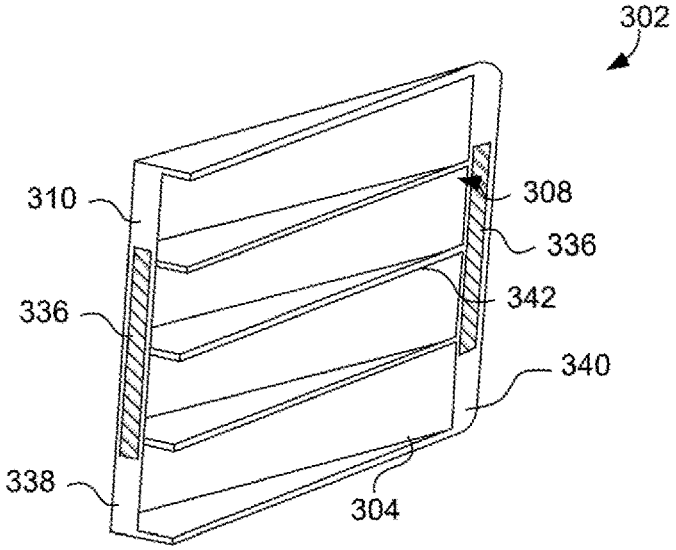

FIGS. 3A-3C illustrate examples of different elements of detachable device 302 that may enable affixing of the device to a rail-post junction. Back portion 308 may be affixed to the rail surface of a fence structure by fastener(s) or adhesive(s), by way of non-limiting example. In some examples, side portion 310 may also be affixed to the post surface of a fence structure by fastener(s) or adhesive(s), by way or non-limiting example.

FIG. 3A, illustrates an example detachable device 302 comprising an aperture to affix body 304 to a rail surface. In one example, the aperture may be a slide aperture 330, which is shown traversing body 304 from transitional surface 306 through to back portion 308. Slide aperture 330 may be arranged such that an installed fastener moves along a line that is perpendicular to a plane of side portion 310 and may comprise a fastener aperture with a slide pathway (see, e.g., the lines on the top and bottom of the aperture) surrounding the fastener aperture. As such, any fastener secured within fastener aperture 330 may be able to remain stationary while body 304 moves with expansion and contraction, such as due to exposure to heat and cold. An example may comprise a fastener at slide aperture 330 location to affix detachable device 302 to the rail at a rail-post junction. Slide aperture 330 may allow for alignment of side portion 310 within proximity to the post. And, as described above, detachable device 302 may thus fill space at the rail-post junction where vegetation may grow.

FIG. 3A also illustrates an example comprising a number of apertures 332*a* and 332*b*, and a number of fastener openings 334*a* and 334*b*, which may enable affixing side portion 310 to the post at a rail-post junction. It is noted that while the example illustrated in FIGS. 3A-3C show two apertures for affixing detachable device 302 to a post and one aperture (e.g., slide aperture 330) for affixing detachable device 302 to a rail, this is done by way of illustration. Other combinations and forms of apertures and attachment mechanisms are also contemplated by claimed subject matter. An example may comprise a fastener traversing body 304 from fastener opening 334*a* through to aperture 332*a* affixing detachable device 302 to the post at a rail-post junction. A fastener may also traverse body 304 from fastener opening 334*b* through to aperture 332*b* further affixing detachable device 302 to the post at a rail-post junction.

Turning now to FIG. 3B, detachable device 302 is illustrated from a perspective as shown by the dashed lines and arrows A in FIG. 3A. In one example, this view of detachable device 302 may be obscured, such as within vegetation. This view shows possible structures of one implementation of detachable device 302 with dashed lines. The structures include an aperture 332*b* traversing body 304 from fastener opening 334*b*. A head of a fastener would thus be arranged within fastener opening, and the threads of the fastener may traverse aperture 332*b* and secure side portion 310 of detachable device 302 to a surface of a post.

FIG. 3B also shows a slide aperture 330 with space to allow a fastener arranged therein to move with respect to body 304, such as in response to expansion and/or contraction due to exposure to heat and cold, by way of example. As noted, slide aperture 330 may include features, such as slide pathway 350, to enable movement of a fastener with respect to body 304. Such an aperture and corresponding fastener would thus allow body 304 to be attached, the fastener passing through slide aperture 330 and back portion and affixing body 304 to a surface of a rail.

FIG. 3C illustrates another view of an example detachable device 302, this time illustrating one example back portion 308. In this example, detachable device 302 comprises an adhesive 336 which may affix detachable device 302 to a fence structure at a rail-post junction (in some cases, in addition to fasteners, such as discussed above). An example adhesive 336 may affix back portion surface 340 of body 304 to the rail surface at a rail-post junction. Another example adhesive 336 may affix side portion surface 338 of body 304 to the post surface at a rail-post junction.

FIGS. 3A and 3C also illustrate a series of ribs 342 traversing the length of side portion 310 of body 304, wherein the ribs provide structural integrity to the body. For instance, ribs 342 may span from back portion surface 340 to side portion surface 338 of body 304 and, while detachable device 302 is attached in a corner junction, may be in proximity to the fence rail. In doing so, ribs 342 increase structural integrity to support body 304 in various conditions (e.g., changing weather conditions, installation and removal, and interactions with circular cutters).

With the foregoing in mind, an example detachable device (e.g., detachable device 302) may comprise a fastener aperture (e.g., slide aperture 330) arranged to enable a fastener to traverse through a body (e.g., body 304) into a plane defined by back portion (e.g., back portion 308) and affixing detachable device 302 to the rail of a rail-post junction. The example device further comprises a slide pathway (e.g., slide pathway 350) surrounding fastener aperture 330 (see, e.g., FIGS. 3A and 3B). As should be appreciated, the slide pathway allows for alignment of the detachable device to the proximity of the post surface (e.g., during installation or adjustments due to weather conditions causing expansion or abatement of the detachable device), such as in order to maintain full coverage of the space between the rail and the post at the rail-post junction and prevent vegetation growth.

Furthermore, an example detachable device may also comprise a second fastener aperture (e.g., aperture 332*b*) arranged to enable a fastener to traverse through a body (e.g., body 304) into a plane defined by side portion 310 and affixing the detachable device 302 to the post at a rail-post junction. Advantageously, affixing the detachable device to the post surface may maintain the device in proximity to the post surface (e.g., in spite of force applied by circular cutters and/or expansion or abatement due to weather condition) and may aid in continued coverage of the space between the rail and the post at rail-post junctions.

With the foregoing in mind, an example fencing system (e.g., fencing system 200 in FIG. 2A) may comprise a fastener aperture (e.g., slide aperture 330) enclosing a fastener and a slide pathway (e.g., slide pathway 350) surrounding the fastener aperture, wherein the fastener is attached to the fence rail. The system further comprises a second fastener aperture enclosing a fastener (e.g., apertures 332*a* and 332*b* and fastener openings 334*a* and 3343*b*), wherein the fastener of the second fastener aperture is attached to the fence post.

For another example detachable device (e.g., detachable device 302), an adhesive receptacle (e.g., side portion surface 338) on a side portion (e.g., side portion 310) of a body (e.g., body 304) enable affixing the device to a rail-post junction (e.g., junction point 220*a* in FIG. 2A). Also, an example detachable device may comprise an adhesive receptacle (e.g., back portion surface 340) on a back portion (e.g., back portion 308) of a body (e.g., body 304).

And, as noted above, in some cases, the fence post and the fence rail may comprise a polyvinyl chloride material.

Figure 4A:
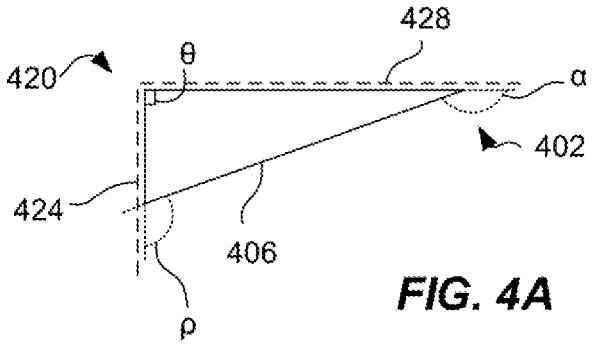
FIGS. 4A-4C illustrate an example detachable device in an example corner junction of an example fence system.
Figure 4B:
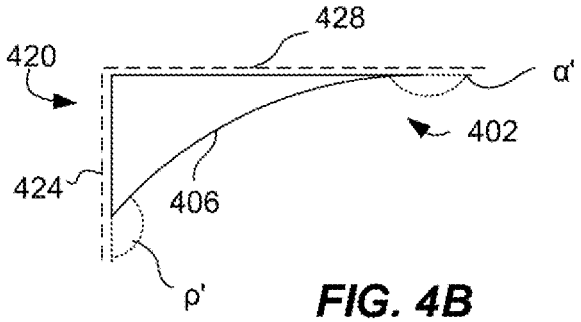
Figure 4C:
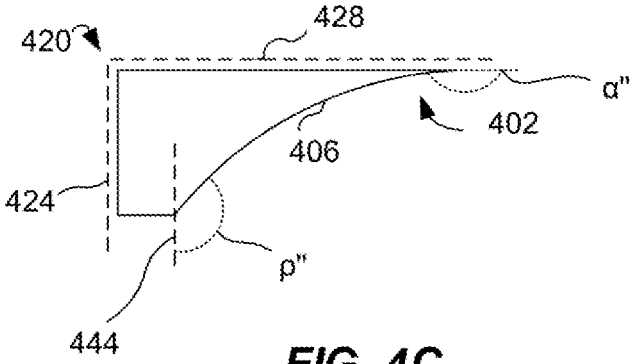

FIGS. 4A-4C illustrate the profile of examples of detachable device 402 (e.g., as viewed from above) comprising a transitional surface 406 spanning from a fence rail surface 428 to a fence post surface 424 and corresponding to the cutting swath of a rotating cutter. FIGS. 4A-4C show different angles formed by transitional surface 406 and the fence post surface 424 and fence rail surface 428. Detachable device 402 is shown in proximity (but not contacting) surfaces of the post and the rail (post surface 424 and rail surface 428). However, it is to be understood that in some examples, detachable device 402 may be attached directly to a fence rail. In other cases, detachable device 402 may be integrated into a fence rail, such as in the form of a lip integrated into the fence rail.

Turning to FIG. 4A, an example detachable device 402 is illustrated, wherein transitional surface 406 comprises a continuous plane extending between rail surface 428 and post surface 424. The continuous plane of transitional surface 406 forming a tapered profile from the side portion of the body to the back portion of the body of detachable device 402. Additionally, dotted lines are shown extending from back and side portions of detachable device 402 to facilitate explanation.

As should be apparent, the back and side surfaces of detachable device 402 join to form a right angle at θ. This angle is mirrored by the angle of post surface 424 and rail surface 428. In contrast, transitional surface 406 forms obtuse angles with these post and rail surfaces 424 and 428, respectively, as shown by angles ρ and α.

FIG. 4B illustrates an example of detachable device 402 wherein transitional surface 406 comprises a continuous arc spanning from rail surface 428 to post surface 424. The continuous arc profile of transitional surface 406 of the body forms an arc between the first extremity (e.g., in proximity to the post surface, post surface 424) and the second extremity (e.g., in proximity to the rail surface, rail surface 428) of detachable device 402. Notably, angles ρ' and α' are greater than their counterpart angles in the implementation of FIG. 4A.

As should be apparent from the foregoing, FIGS. 4A-4B illustrate detachable device 402 attached at the ninety-degree angle of rail-post junction point 420. The angle between the plane of rail surface 428 and transitional surface 406 (angle α in FIG. 4A and angle α' in FIG. 4B) is greater than ninety degrees (e.g., obtuse) and the angle between transitional surface 406 and the plane of post surface 424 (angle ρ in FIG. 4A and angle ρ' in FIG. 4B) is greater than ninety degrees (e.g., obtuse).

FIG. 4C illustrates an example of detachable device 402 wherein transitional surface 406 comprises an arc from rail surface 428 to a plane 444 that is parallel to a fence post face (post surface 424). The arc length corresponds to the radius of an arc of a circular cutting swath (e.g., for instance, fora 6-inch cutter swath radius, the arc defined by transitional surface 406 may be approximately 6 inches). FIG. 4C also illustrates detachable device 402 attached at the ninety-degree angle of rail-post junction point 420, wherein the angle (e.g., angle α") between the plane of rail surface 428 and transitional surface 406 is greater than ninety degrees (e.g., obtuse). And, as noted above, the angle (e.g., angle ρ") between transitional surface 406 and plane 444 (plane 444 being parallel with the plane of fence post surface 424) is greater than ninety degrees (e.g., obtuse).

Further, FIGS. 4A-4C illustrate an example detachable device (e.g., detachable device 402), wherein a plane defined by the side portion is approximately perpendicular to a plane defined by the back portion, corresponding to the ninety-degree angle of post-rail junction point 420.

With the foregoing in mind, an example fence structural rail component may comprise a lip (e.g., device 402) arranged in proximity to a junction point (e.g., junction point 420), the lip having a profile to form an arc or an obtuse angle between the lip and a surface of the fence structural rail component (e.g., rail surface 428), and a connection point portion to interface with an opening of a fence post component (e.g., post surface 424). Furthermore, the lip may comprise a body extending from a surface of the rail component (e.g., rail surface 428) in proximity to the junction point (e.g., junction point 420) towards the fence post component (e.g., post surface 424).

Also, with the foregoing in mind, an example fencing system (e.g., system 200 of FIG. 2A) may comprise a body (e.g., body 304 of FIG. 3A) integrated into the fence post, the fence rail, or a combination thereof. The body may further comprise an outer surface which forms an obtuse angle with respect to a surface of the fence rail (e.g., rail surface 428). Also, the body may further comprise an outer surface (e.g., transitional surface 406) which forms an obtuse angle with respect to a surface of the fence post (e.g., post surface 424).

For another example detachable device (e.g., detachable device 402), a plane defined by the side portion is approximately perpendicular to a plane defined by the back portion (e.g., as shown in FIGS. 4A-4C).

With the foregoing in mind, a detachable device with a transitional surface to fill corner junctions of a fence system is contemplated by claimed subject matter, such as to keep vegetation from growing in the corner fence junction.

In the preceding description, various aspects of claimed subject matter have been described. For purposes of explanation, specifics, such as amounts, systems and/or configurations, as examples, were set forth. In other instances, well-known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all modifications and/or changes as fall within claimed subject matter.

What is claimed is:

1. A fence rail detachable device comprising:

a body comprising:

a transitional surface to span from a surface of a rail of a fence structure to a surface of a post portion of the fence structure, and to form an obtuse angle between a point of contact of the transitional surface and the surface of the rail of the fence structure;

a side portion comprising apertures arranged proximate to the post portion of the fence structure, wherein the apertures are to receive fasteners to secure the side portion of the body to the post portion of the fence structure;

an upper surface spanning from an upper most portion of the transitional surface to the surface of the rail of the fence structure and to the surface of the post portion;

a lower surface spanning from a lower most portion of the transitional surface to the surface of the rail of the fence structure and the surface of the post portion;

wherein the upper surface and the lower surface comprise a triangular shape or a substantially triangular shape, and further wherein the substantially triangular shape is defined by a right angle formed by an intersection of the surface of the rail and the surface of the post portion and an arcuate shape of the transitional surface;

a slide aperture arranged in the body, the slide aperture to enable a fastener to traverse a plane defined by a back portion of the body and to secure the body to the rail of the fence structure; and a rib arranged in a void between the transitional surface, the side portion, the upper surface, and the lower surface and arranged to be in proximity to the rail of the fence structure, the rib arranged to traverse the length of the body in a direction parallel to the upper surface, the lower surface, and the rail of the fence structure from the post portion of the fence structure towards the point of contact of the transitional surface and the surface of the rail of the fence structure;

wherein the transitional surface is longer than the side portion and longer than the back portion.

2. The fence rail detachable device of claim 1, wherein the transitional surface has a profile that corresponds to a cutting swath of a rotating cutter.

3. The fence rail detachable device of claim 1, wherein the body comprises a polyvinyl chloride material.

4. The fence rail detachable device of claim 1, wherein a plane defined by the side portion is approximately perpendicular to a plane defined by the back portion.

5. The fence rail detachable device of claim 4, wherein the transitional surface forms a tapered profile from the side portion to the back portion.

6. The fence rail detachable device of claim 4, further comprising an adhesive receptacle on the side portion of the body and an adhesive receptacle on the back portion of the body.

7. The fence rail detachable device of claim 1, wherein the transitional surface of the body forms an arc between a first extremity and a second extremity.

8. The fence rail detachable device of claim 1, wherein the slide aperture further comprises a slide pathway arranged to enable a fastener to remain stationary while the body moves with expansion and contraction.

9. The fence rail detachable device of claim 1, wherein the transitional surface comprises an arc from the surface of the rail of the fence structure to a plane parallel to a face of the post portion of the fence structure, wherein the arc length corresponds to a radius of a cutting swath of a rotating cutter.

10. The fence rail detachable device of claim 1, wherein the fastener of the slide aperture traverses the transitional surface of the body.

11. The fence rail detachable device of claim 1, wherein the fasteners of the side portion apertures traverse the transitional surface of the body.

12. A fence structural rail component comprising:

a connection point to interface with an opening of a fence post component; and a lip integrated into the fence structural rail component and arranged in proximity to a junction point on the fence structural rail component, the lip comprising:

a body extending from a surface of the fence structural rail component in proximity to the junction point towards the fence post component, the body made up of a transitional surface, a side portion, an upper surface, a lower surface, and a rib, wherein the upper surface and the lower surface comprise a triangular shape or a substantially triangular shape, and further wherein the substantially triangular shape is defined by a right angle formed by an intersection of a surface of the fence structural rail component and the fence post component and an arcuate shape of the transitional surface;

the transitional surface spanning from the surface of the fence structural rail component towards a surface of the fence post component, the transitional surface having a profile to form an arc or an obtuse angle between the lip and a surface of the fence structural rail component;

the side portion arranged with respect to the connection point and the surface of the fence structural rail component to be in proximity to the fence post component while the connection point is interfaced with the opening of the fence post component, the side portion sized to cover at least half of the surface of the fence post component from the connection point to an end of the surface of the fence post;

the upper surface spanning from an upper most portion of the transitional surface to the surface of the fence structural rail component and to the fence post component;

the lower surface spanning from a lower most portion of the transitional surface to the surface of the fence structural rail component and to the fence post component; and the rib arranged in a void between the transitional surface, the side portion, the upper surface, and the lower surface, the rib arranged to span from the surface of the fence structural rail component towards the side portion, traversing the length of the body in a direction parallel to the upper surface, the lower surface, and fence structural rail component;

wherein the transitional surface of the body is longer than the side portion of the body.

13. A fence structural rail component of claim 12, wherein a plane defined by the side portion is approximately perpendicular to a plane defined by the surface of the fence structural rail component.

14. A fencing system comprising:

a fence post;

a fence rail contacting the fence post at an angle; and a body arranged between the fence post and the fence rail, affixed to the fence rail, and filling a space between the vertex of the angle and an outer surface of the body, opposite the vertex, wherein the body comprises:

the outer surface of the body to span from a surface of the fence rail to a surface of the fence post;

a side portion comprising apertures arranged proximate to the fence post, wherein the apertures are to receive fasteners to secure the side portion of the body to the fence post;

an upper surface spanning from an upper most portion of the outer surface to the fence rail and to the fence post;

a lower surface spanning from a lower most portion of the outer surface to the fence rail and the fence post;

wherein the upper surface and the lower surface comprise a triangular shape or a substantially triangular shape, and further wherein the substantially triangular shape is defined by a right angle formed by an intersection of the fence rail and the fence post and an arcuate shape of the outer surface;

a slide aperture arranged in the body, the slide aperture to enable a fastener to traverse a plane defined by a back portion of the body and to secure the body to the fence rail; and a rib arranged in a void between the outer surface, the side portion, the upper surface, and the lower surface and arranged to be in proximity to the fence rail, the rib arranged to traverse the length of the body in a direction parallel to the upper surface, the lower surface, and the fence rail and spanning from the surface of the fence post towards the surface of the fence rail;

wherein the outer surface of the body is longer than the side portion and longer than the back portion of the body.

15. The system of claim 14, wherein the slide aperture further comprises:

a slide pathway, the body to move along the fastener at the slide pathway of the slide aperture to enable alignment of the side portion of the body to the proximity of the fence post.

16. The system of claim 14, wherein the fence post and the fence rail comprise a polyvinyl chloride material.

17. The system of claim 14, wherein the outer surface of the body forms an obtuse angle with respect to a surface of the fence rail.

18. The system of claim 17, wherein the outer surface of the body forms an obtuse angle with respect to a surface of the fence post.

19. The system of claim 14, wherein the outer surface of the body comprises an arc from the surface of the fence rail to a plane parallel to a fence post face, the arc length to correspond to a radius of an arc of a circular cutting swath of a rotating cutter.

20. The system of claim 14, wherein the side portion of the body is arranged to be in direct physical contact with the fence post and the back portion of the body is arranged to be in direct physical contact with the fence rail.

* * * * *